US007532840B2

(12) United States Patent
Nishimura et al.

(10) Patent No.: US 7,532,840 B2
(45) Date of Patent: May 12, 2009

(54) PROCESS CARTRIDGE AND IMAGE FORMING APPARATUS

(75) Inventors: Soichiro Nishimura, Handa (JP); Makoto Ishii, Nagoya (JP); Yoshinori Ito, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 181 days.

(21) Appl. No.: 11/188,729

(22) Filed: Jul. 26, 2005

(65) Prior Publication Data

US 2006/0024086 A1 Feb. 2, 2006

(30) Foreign Application Priority Data

Jul. 29, 2004 (JP) ..... 2004-222541

(51) Int. Cl.
*G03G 21/16* (2006.01)

(52) U.S. Cl. ..... 399/111

(58) Field of Classification Search ..... 399/111, 399/107, 123, 343, 349, 351, 353, 354, 90
See application file for complete search history.

(56) References Cited

U.S. PATENT DOCUMENTS

| | | | | |
|---|---|---|---|---|
| 5,208,634 | A | 5/1993 | Ikemoto et al. | |
| 5,294,960 | A | 3/1994 | Nomura et al. | |
| 5,470,635 | A | 11/1995 | Shirai et al. | |
| 5,608,509 | A | 3/1997 | Shirai et al. | |
| 5,623,328 | A | 4/1997 | Tsuda et al. | |
| 5,659,847 | A | 8/1997 | Tsuda et al. | |
| 5,669,042 | A | 9/1997 | Kobayashi et al. | |
| 5,682,579 | A | 10/1997 | Nomura et al. | |
| 5,828,928 | A | 10/1998 | Sasago et al. | |
| 5,828,929 | A | 10/1998 | Watanabe et al. | |
| 5,907,749 | A | 5/1999 | Nomura et al. | |
| 5,987,278 | A | 11/1999 | Nomura et al. | |
| 6,118,961 | A | 9/2000 | Nomura et al. | |
| 6,304,735 | B1 * | 10/2001 | Nishimura et al. | 399/98 |
| 6,516,175 | B2 * | 2/2003 | Ogasawara | 399/298 |
| 6,871,030 | B2 * | 3/2005 | Nishimura | 399/98 |
| 2004/0052558 | A1 | 3/2004 | Mizoguchi et al. | |
| 2005/0169669 | A1 * | 8/2005 | Nishimura et al. | 399/149 |

FOREIGN PATENT DOCUMENTS

| | | | |
|---|---|---|---|
| EP | 0411579 | A2 * | 6/1991 |
| JP | 61-076451 | | 5/1986 |
| JP | 3-004237 | A | 1/1991 |
| JP | 6-019242 | A | 1/1994 |
| JP | 6-317970 | A | 11/1994 |
| JP | 7-160163 | A | 6/1995 |
| JP | 09068912 | A * | 3/1997 |

(Continued)

*Primary Examiner*—David M Gray
*Assistant Examiner*—Andrew V Do
(74) *Attorney, Agent, or Firm*—Banner & Witcoff, Ltd

(57) ABSTRACT

A brush holder for use in a process cartridge is integrally formed with a brush attachment portion, an extended end portion, a central extended portion, a downward extended portion, an electrode connection portion, and an electrode portion. The brush holder is formed longer than a brush. A holder supporting wall is provided at a brush mounting portion. The brush holder is supported by fitting a recess defined between the brush attachment portion and the downward extended portion onto the holder supporting wall.

17 Claims, 11 Drawing Sheets

FOREIGN PATENT DOCUMENTS

| | | | |
|---|---|---|---|
| JP | 9-244503 | | 9/1997 |
| JP | 9-244504 | | 9/1997 |
| JP | 9-244515 | | 9/1997 |
| JP | 9-319273 | | 12/1997 |
| JP | 2001-159839 | A | 6/2001 |
| JP | 2004-004986 | A | 1/2004 |
| JP | 2004-157512 | A | 6/2004 |

* cited by examiner

PROCESS CARTRIDGE AND IMAGE FORMING APPARATUS

CROSS REFERENCE TO RELATED APPLICATION

This application claims priority from Japanese Patent Application No. 2004-222541, filed Jul. 29, 2004, the entire subject matter of which is incorporated herein by reference.

BACKGROUND

The disclosure relates to an image forming apparatus, such as a laser printer, and a process cartridge for use in the image forming apparatus.

Conventionally, a process cartridge for use in image forming apparatuses, such as laser printers, includes a charger, a developing roller, and a transfer roller that are disposed around a photosensitive drum. In accordance with the rotation of the photosensitive drum, its surface is uniformly charged by the charger, and then selectively exposed to a laser beam. This process partially removes electrical charges from the surface of the photosensitive drum to form an electrostatic latent image on the surface of the photosensitive drum. The electrostatic latent image on the surface of the photosensitive drum is developed into a toner image as toner is supplied from the developing roller when the electrostatic latent image is brought into contact with the developing roller. The toner image carried on the surface of the photosensitive drum faces the transfer roller, and is transferred to a sheet passing between the photosensitive drum and the transfer roller.

A known process cartridge is provided with a brush, on the downstream side of the transfer roller with respect to the rotating direction of the photosensitive drum for removing foreign materials such as the paper fibers or powders attached to the surface of the photosensitive drum after the toner image has been transferred on the sheet. The brush is disposed so as to slide on the surface of the photosensitive drum. In accordance with the rotation of the photosensitive drum, foreign materials on the surface of the photosensitive drum are physically caught by the brush and electrically attracted by the application of cleaning bias.

For example, Japanese Laid-Open Utility Model Publication No. 61-76451 discloses a conductive brush for charging a surface of a photosensitive member, attached to a base. An end of the base is held by a substantially U-shaped supporting member to make the brush contact the surface of the photosensitive member.

SUMMARY

Aspects provide a process cartridge that can achieve reduction of the number of components to be used and improve the ease of assembly, and an image forming apparatus for use with the process cartridge.

According to some aspects, the process cartridge may include an image carrying member capable of carrying a developer image, a brush for removing foreign material attached to the image carrying member, and a brush holder integrally formed with a supported portion, a brush attachment portion to which the brush is attached, and an electrode portion to which voltage is applied to electrically attract the foreign material to the brush, the brush holder being formed of a metal plate. Also, according to some aspects, the process cartridge can include a cartridge frame capable of accommodating the image carrying member, the brush and the brush holder, and a supporter capable of supporting the supported portion, the supporter being provided at the cartridge frame.

BRIEF DESCRIPTION OF THE DRAWINGS

An illustrative embodiment will be described in detail with reference to the following figures wherein.

DETAILED DESCRIPTION

Figure 1:
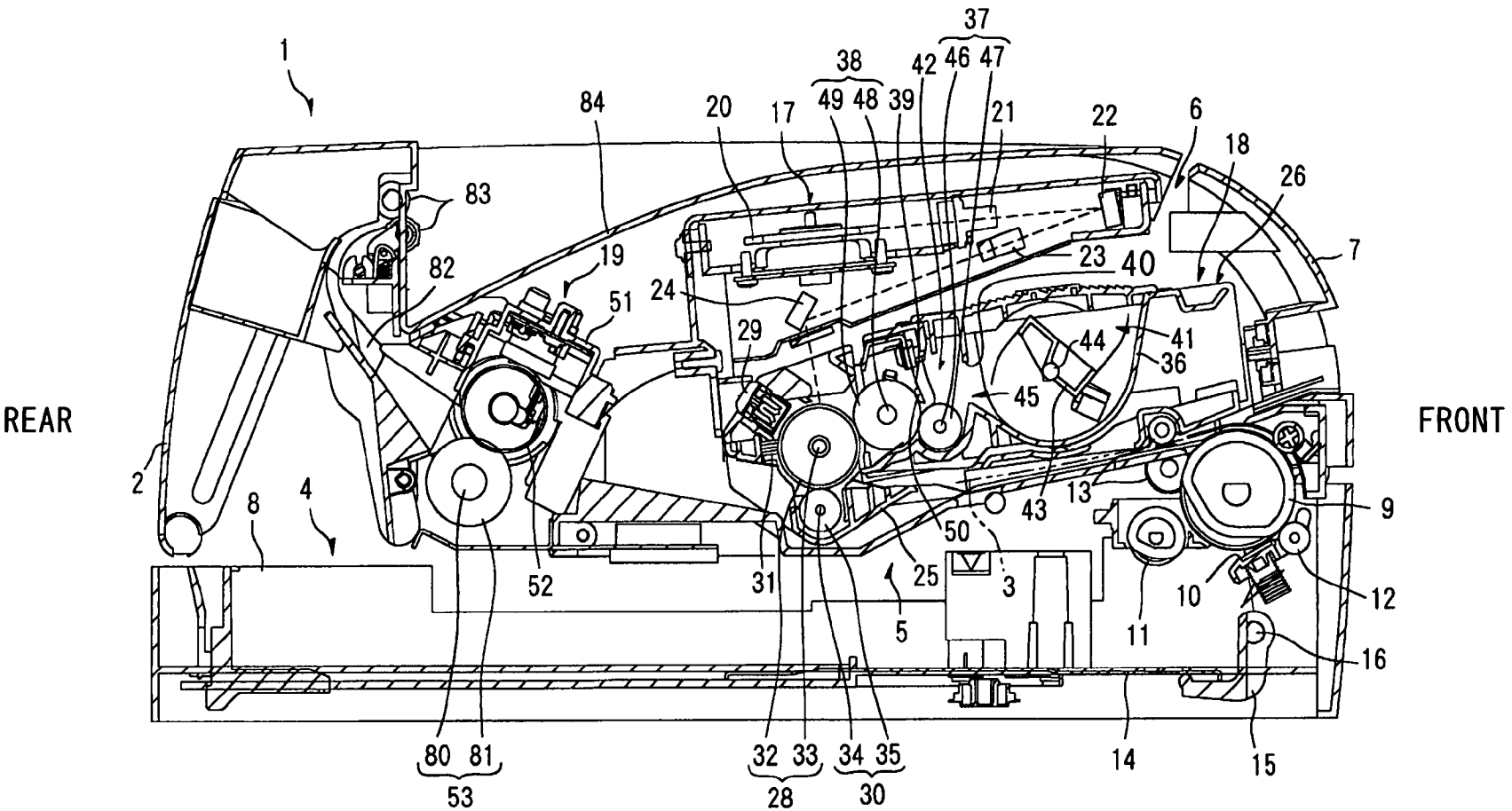
FIG. 1 is a sectional view of the parts of a laser printer as an image forming apparatus of an illustrative embodiment when a front cover is closed.

An illustrative embodiment will be described in detail with reference to the accompanying drawings. As shown in FIG. 1, a laser printer 1 is provided, in a main casing 2, with a feeder unit 4 that supplies a sheet 3, and an image forming unit 5 that forms an image on the supplied sheet 3.

The main casing 2 is formed with an opening 6 through which a process cartridge 18 is inserted in or removed from the main casing 2 and a front cover 7 capable of opening and closing the opening 6.

Figure 2:
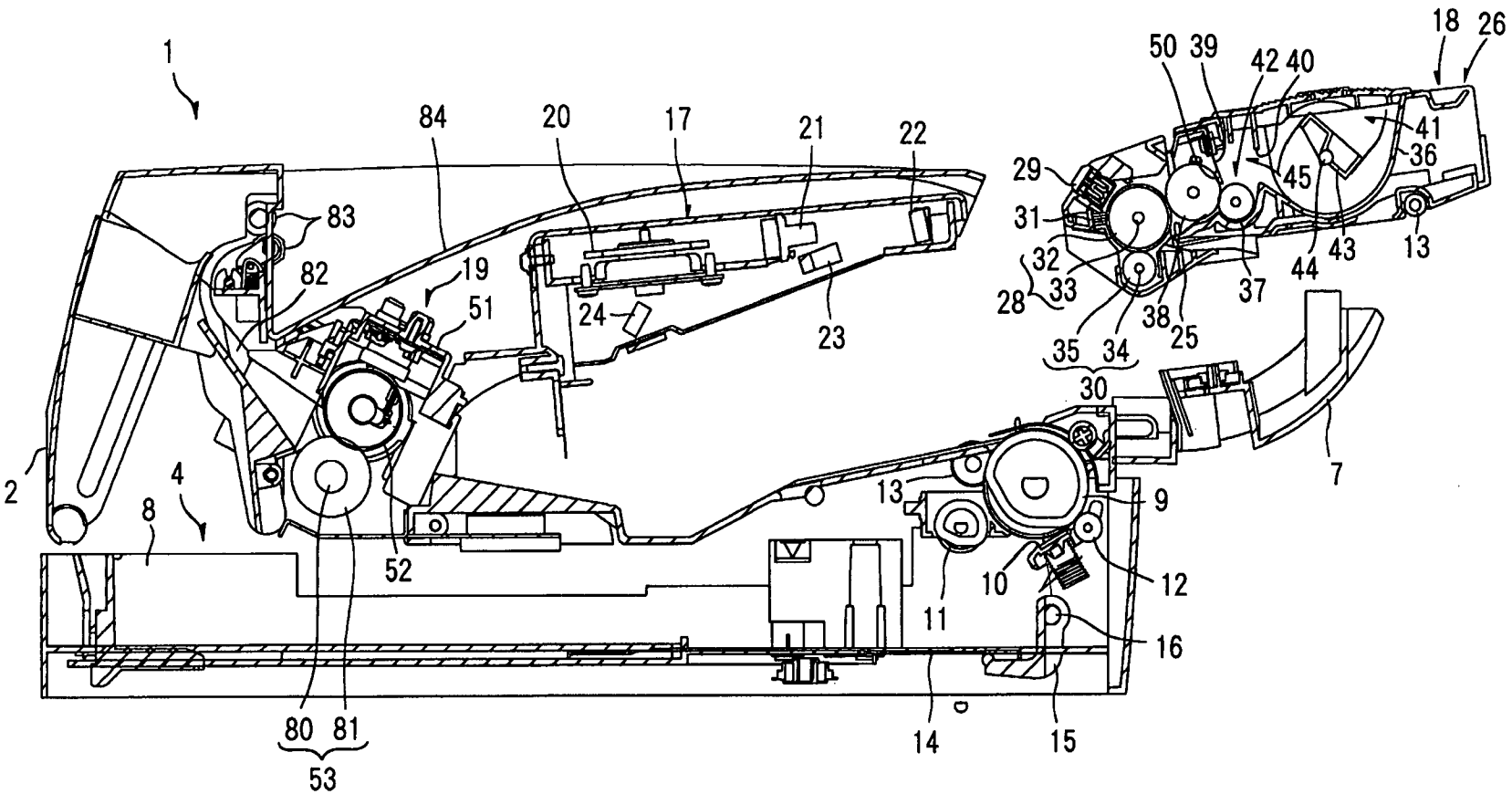
FIG. 2 is a sectional view of the parts of the laser printer shown in FIG. 1 when the front cover is open.

The front cover 7 is pivotally supported by a cover shaft (not shown), which is inserted into a lower end portion of the front cover 7. When the front cover 7 is pivotally closed about the cover shaft, the opening 6 is closed by the front cover 7, as shown in FIG. 1. When the front cover 7 is pivotally opened (tilted) about the cover shaft, the opening 6 is open, as shown in FIG. 2, so that the process cartridge 18 can be inserted into or removed from the main casing 2 through the opening 6.

In the illustrative embodiment, when the process cartridge 18 is installed in the main casing 2, the side on which the front cover 7 is provided is defined as the front side of the laser printer 1/process cartridge 18 (including a developing cartridge 26), and the side opposite to the front side is defined as the rear side.

The feeder unit 4 is provided, at a bottom portion in the main casing 2, with a sheet supply tray 8, a sheet supply roller 9, a separation pad 10, a pickup roller 11, a pinch roller 12, and register rollers 13. The sheet supply tray 8 is removably set on the bottom portion of the main casing 2. The sheet supply roller 9 and the separation pad 10 are provided at upper front end portions of the sheet supply tray 8. The pickup roller 11 is provided at a rear side of the sheet supply roller 9. The pinch roller 12 is disposed opposite the sheet supply roller 9 at a lower front side thereof. The register rollers 13 are provided at an upper rear side of the sheet supply roller 9.

Provided inside the sheet supply tray 8 is a sheet mount plate 14 capable of mounting thereon a stack of sheets 3. The sheet mount plate 14 is pivotally supported about its rear end, so as to allow its front end to move in a vertical direction.

A lever 15 for raising the front end of the sheet mount plate 14 is provided at a front end portion of the sheet supply tray 8. The lever 15 is formed substantially L-shaped in a sectional view so as to extend from the front side of the sheet mount plate 14 to the underside thereof. The upper end of the lever 15 is attached to a lever shaft 16 provided at the front end portion of the sheet supply tray 8. The rear end of the lever 15 makes contact with the lower front end surface of the sheet mount plate 14. When a rotation force in the clockwise direction (in FIG. 1) is transmitted to the lever shaft 16, the lever 15 is rotated about the lever shaft 16 to raise the front end of the sheet mount plate 14 with the rear end of the lever 15.

As the front end of the sheet mount plate 14 is raised, an uppermost sheet 3 on the sheet mount plate 14 is pressed against the pickup roller 11, and is conveyed between the sheet supply roller 9 and the separation pad 10 in accordance with rotation of the pickup roller 11.

When the sheet supply tray 8 is removed from the main casing 2, the front end of the sheet mount plate 14 is moved down by its own weight substantially parallel to the bottom of the sheet supply tray 8. In this state, a stack of sheets 3 can be mounted on the sheet supply tray 8.

The uppermost sheet 3 conveyed by the pickup roller 11 toward the sheet supply roller 9 and the separation pad 10, is sandwiched between the sheet supply roller 9 and the separation pad 10 by the rotation of the sheet supply roller 9, and reliably fed toward the register rollers 13, through a portion between the sheet supply roller 9 and the pinch roller 12.

The register rollers 13 are made up of a pair of rollers that are disposed opposite each other. The register rollers 13 register or correct the skew of the sheet 3 and then feed the sheet 3 to a transfer position between a photosensitive drum 28 and a transfer roller 30 where toner image on the photosensitive drum 28 is transferred onto the sheet 3.

The image forming unit 5 includes a scanner unit 17, the process cartridge 18, and a fixing unit 19.

The scanner unit 17 is disposed at an upper portion in the main casing 2. The scanner unit 17 includes a laser light source (not shown), a polygon mirror 20 that is driven so as to spin, an fθ lens 21, a reflecting mirror 22, a lens 23, and a reflecting mirror 24. As shown in dashed lines in FIG. 1, a laser beam emitted from the laser light source based on image data, is deflected by the polygon mirror 20 and passes through the fθ lens 21. Then, the laser beam is reflected off the reflecting mirror 22, and directed, through the lens 23, to the reflecting mirror 24 where the laser beam is bent downward toward the surface of the photosensitive drum 28 of the process cartridge 18. Thus, the surface of the photosensitive drum 28 is irradiated with the laser beam at high speed.

The process cartridge 18 is removably mounted on the main casing 2 below the scanner unit 17. The process cartridge 18 includes a drum cartridge 25 and a developing cartridge 26 removably set in the drum cartridge 25.

Figure 3:
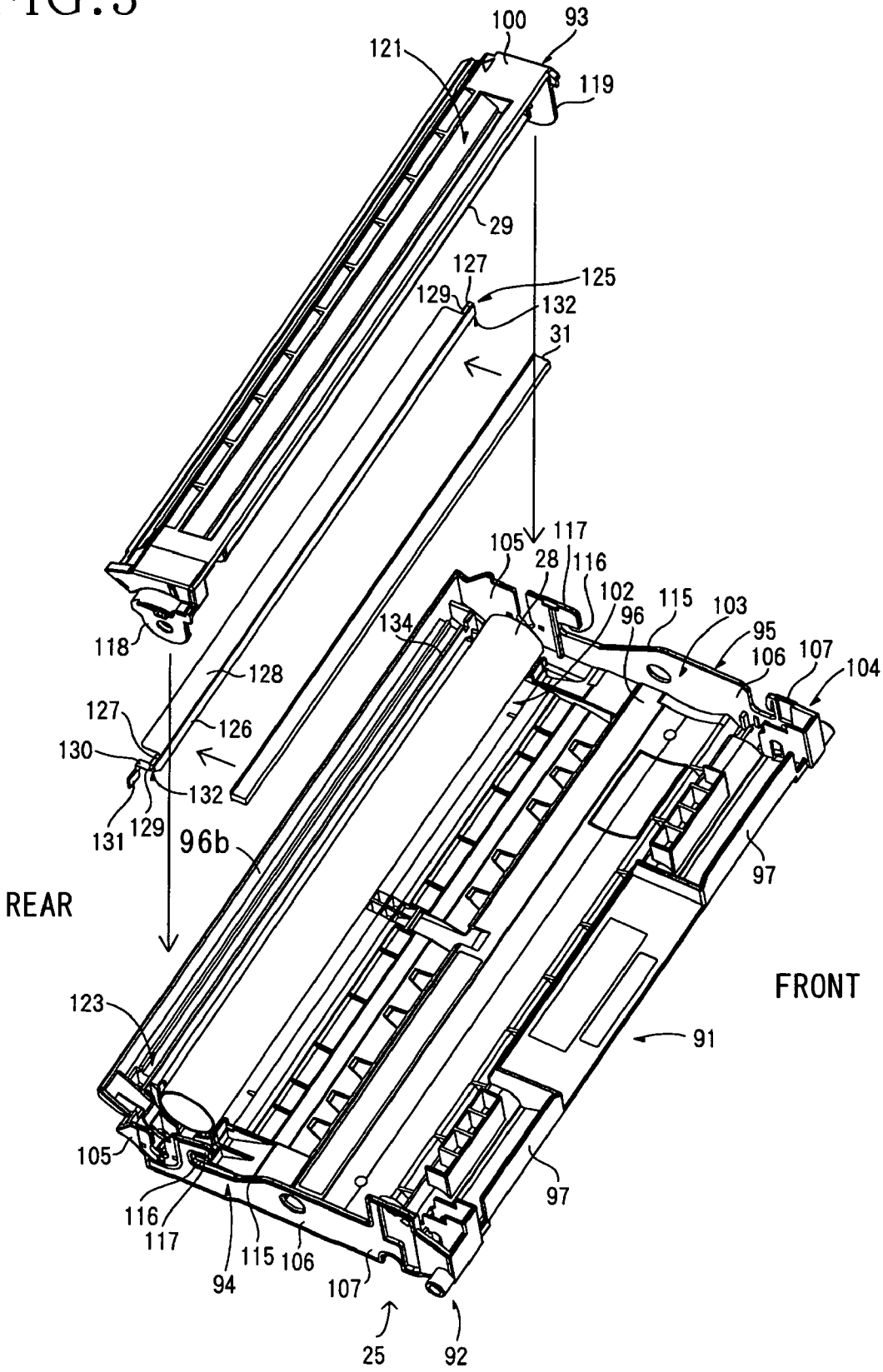
FIG. 3 is an exploded view of a drum cartridge shown in FIG. 1.
Figure 4:
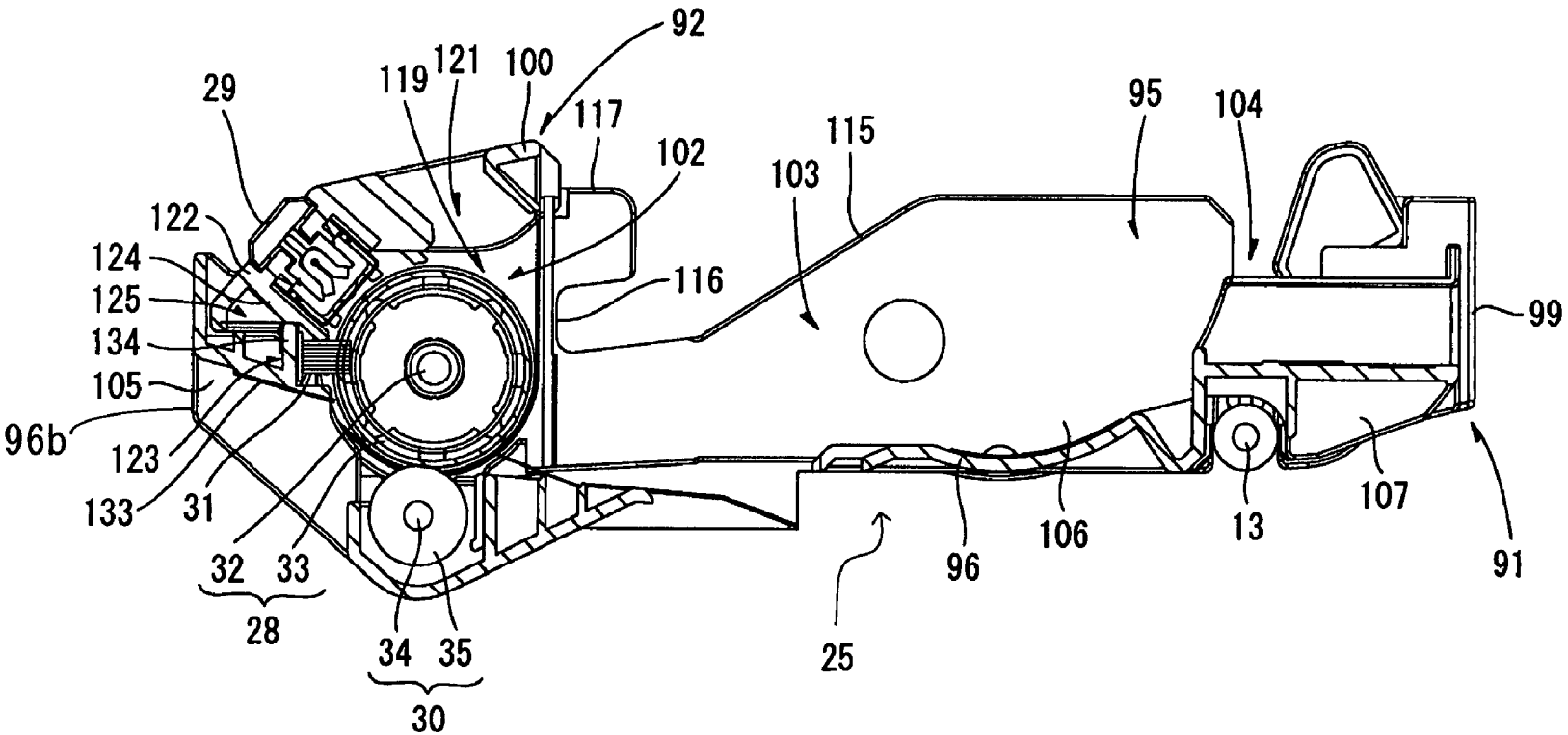
FIG. 4 is a side view of the drum cartridge shown in FIG. 1.

As shown in FIGS. 3 and 4, the drum cartridge 25 includes a frame 91 as a cartridge frame, and the photosensitive drum 28, as an image carrying member, and a scorotron charger 29, the transfer roller 30 and a brush 31 that are disposed in the frame 91.

The frame 91 includes a lower frame 92, as a first frame, and an upper frame 93, as a second frame, that mates with the lower frame 92. The lower frame 92 and the upper frame 93 are separately formed.

The lower frame 92 is provided with a left side wall 94, a right side wall 95, a bottom wall 96, and a front wall 97 that are integrally formed.

The left side wall 94 and the right side wall 95 are disposed to face each other, with some distance therebetween in the longitudinal direction of the lower frame 92, as shown in FIG. 3, perpendicular to the front and rearward direction. Each of the left side wall 94 and the right side wall 95 has a rear wall portion 105, a front wall portion 106, and an extended wall portion 107 that are integrally formed to extend respectively from the rear side to the front side.

The front wall portion 106 is provided with a roller shaft guiding portion 115 for guiding an end of a developing roller shaft 48 (described below) when the developing cartridge 26 is removably set in the drum cartridge 25 and a roller shaft receiving portion 116 for receiving an end of the developing roller shaft 48 guided by the roller shaft guiding portion 115. The roller shaft receiving portion 116 is formed integrally with the roller shaft guiding portion 115 so as to extend rearward from the rear end of the guiding portion 115.

The roller shaft guiding portion 115 is formed as an upper edge of the front wall portion 106. The roller shaft guiding portion 115 has a slope portion that extends downwardly rearward from a middle portion of the front wall portion 106 with respect to the forward and rearward direction, and a flat portion that extends substantially horizontally from the rear end of the slope portion of the roller shaft guiding portion 115.

The roller shaft receiving portion 116 is formed by cutting out a part of a protruded wall 117, which protrudes above the rear end of the shaft guiding portion 115, into a substantially rectangular shape in side view, from a front side of the protruded wall 117. The lower end of the roller shaft receiving portion 116 is connected to the rear end of the shaft guiding portion 115.

The extended wall portion 107 is integrally formed with the front wall portion 106 to be flush with the front wall portion 106 in the longitudinal direction of the lower frame 92.

The bottom wall 96 is of a substantially flat shape and connected to lower edges of the left side wall 94 and the right side wall 95 along the frontward and rearward direction. A brush mounting portion 123 where a brush 31 is disposed is provided at a rear portion of the bottom wall 96.

The front wall 97 extends upward from the front end of the bottom wall 96 substantially vertical to the bottom wall 96. The front wall 97 is of a substantially flat shape. Ends of the front wall 97 with respect to the longitudinal direction of the lower frame 92 are connected at right angles with the left side wall 94 and the right side wall 95.

The upper frame 93 is integrally formed with an upper rear wall 100 and an upper left side wall 118 and an upper right side wall 119 that extend downward from ends of the upper rear wall 100 with respect to the longitudinal direction of the upper frame 93.

The upper rear wall 100 is provided at a front side thereof with a laser entrance window 121 of substantially rectangular shape in a plan view. The laser entrance window 121 extends along the longitudinal direction of the upper frame 93. The upper rear wall 100 is also provided with a charger supporting portion 122 that is disposed at a position behind and below the laser entrance window 121 for supporting the scorotron charger 29. Disposed below the scorotron charger 29 which is supported by the charger supporting portion 122 are two supporting ribs 124, as second contact portions, that contact each of extended end portions 127 of a brush holder 125 (described below) when the lower frame 92 and the upper frame 93 are put together or mated. The supporting ribs 124 are disposed to face each other on the underside of the upper rear wall 100, with some distance in its longitudinal direction between the supporting ribs 124.

Figure 11:
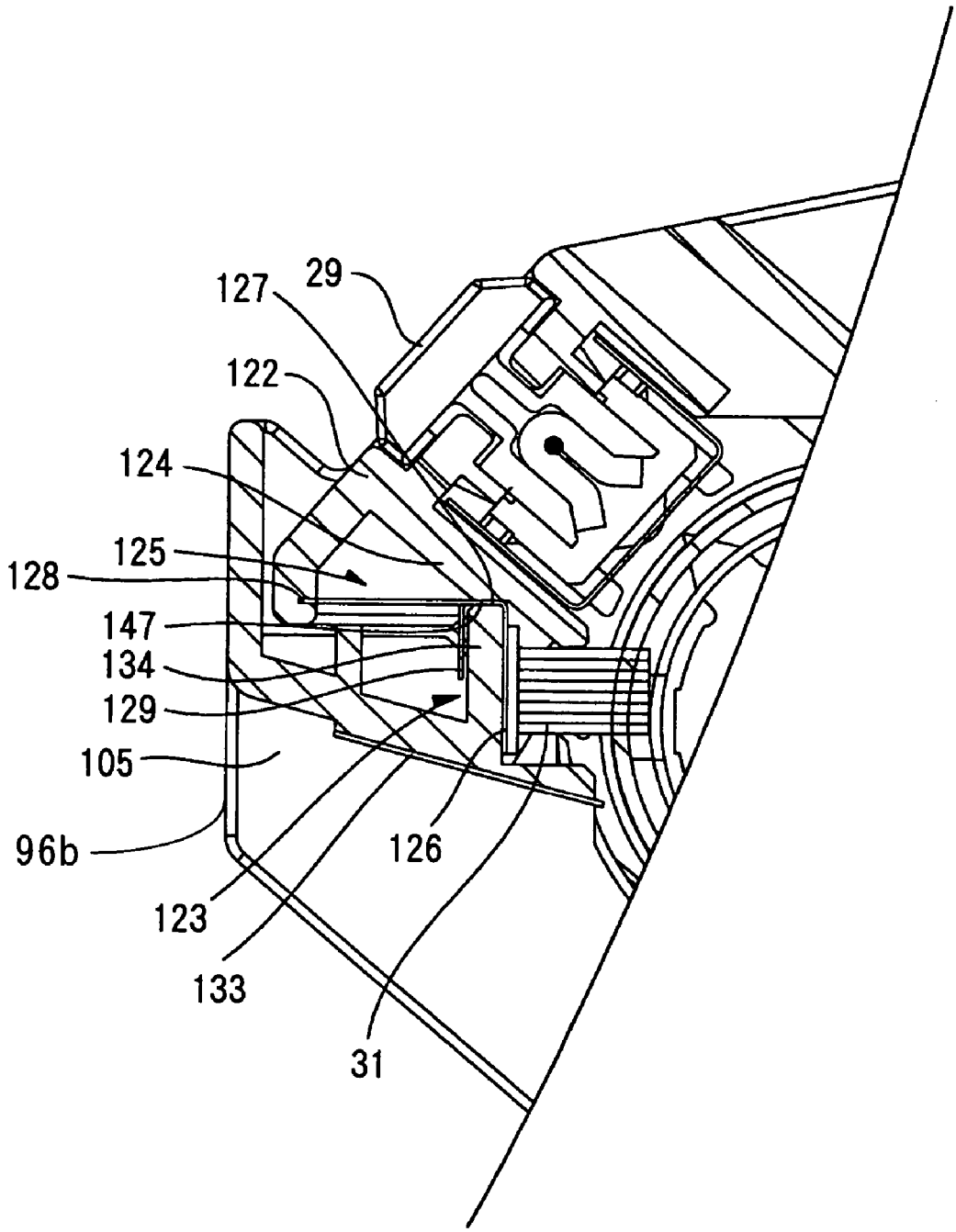
FIG. 11 is a sectional side view showing structures near a brush of the drum cartridge shown in FIG. 4.

Each supporting rib 124 is formed thin with respect to the longitudinal direction of the upper frame 93. As shown in FIG. 11, the supporting rib 124 extends obliquely downwardly from the rear side toward the front side, perpendicular to the longitudinal direction of the brush holder 125. A contact surface 147 is formed on the lower end of the supporting rib 124. The contact surface 147 contacts a holder supporting wall 134 (described below) substantially parallel to an upper surface of the holder supporting wall 134. When the lower frame 92 and the upper frame 93 are put together, the contact surface 147 contacts each extended end portion 127 of the brush holder 125, thereby supporting the brush holder 125 between the supporting ribs 124 and the holder supporting wall 134.

The upper left side wall 118 and the upper right side wall 119 are of a substantially triangular shape in side view. When the upper frame 93 is set relative to the lower frame 92, the upper left side wall 118 and the upper right side wall 119 are placed outwardly of the left side wall 94 and the right side wall 95 of the lower frame 92, respectively.

With the lower frame 92 and the upper frame 93 put together, the rear wall portion 105 of each of the left side wall 94 and the right side wall 95, the upper rear wall 100, and a rear portion 96*b* of the bottom wall 96 define a drum accommodating portion 102, which is open to receive the photosensitive drum 28. A developing cartridge accommodating portion 103 is defined by the front wall portion 106 of each of the left side wall 94 and the right side wall 95 and the bottom wall 96 extending between the front wall portions 106 of the left and right side walls 94, 95. The developing cartridge accommodating portion 103 is open upward. The front side of the developing cartridge accommodating portion 103 is connected to a lower extended portion 104 and the rear side of the developing cartridge accommodating portion 103 communicates with the drum accommodating portion 102. The lower extended portion 104 is defined as an upward-open space by the extended side wall portions 107 of the left and right side walls 94, 95, the bottom wall 96 extending between the extended wall portions 107, and the front wall 97. The lower extended portion 104 communicates at its rear side with the developing cartridge accommodating portion 103.

The photosensitive drum 28 is provided in the drum accommodating portion 102. The photosensitive drum 28 includes a cylindrical drum body 32 having at its outermost surface a positively chargeable photosensitive layer made from, for example, polycarbonate and a metal drum shaft 33 disposed along a longitudinal direction of the drum body 32 at an axis of the drum body 32. The drum shaft 33 is fixedly supported by the left side wall 94 and the right side wall 95 of the drum cartridge 25. The drum body 32 is supported so as to rotate on the drum shaft 33. Thus, the photosensitive drum 28 is rotatably supported about the drum shaft 33 between the left side wall 94 and the right side wall 95.

The scorotron charger 29 is supported by the charger supporting portion 122. The scorotron charger 29 is disposed at an upper rear portion of the photosensitive drum 28 with a predetermined distance between the scorotron charger 29 and the photosensitive drum 28, to prevent the scorotron charger 29 from contacting the photosensitive drum 28. The charger 29 is a positively charging scorotron charger that generates corona discharge from, for example, a tungsten wire. The scorotron charger 29 uniformly and positively charges the surface of the photosensitive drum 28.

The transfer roller 30 is arranged below the photosensitive drum 28 and rotatably supported by the right side wall 94 and the right side wall 95. The transfer roller 30 includes a metal transfer roller shaft 34 covered by a rubber roller 35 formed of an ionic conductive rubber material. A transfer bias is applied to the transfer roller 30 during transfer of the toner onto a recording medium, such as a sheet.

Figure 6:
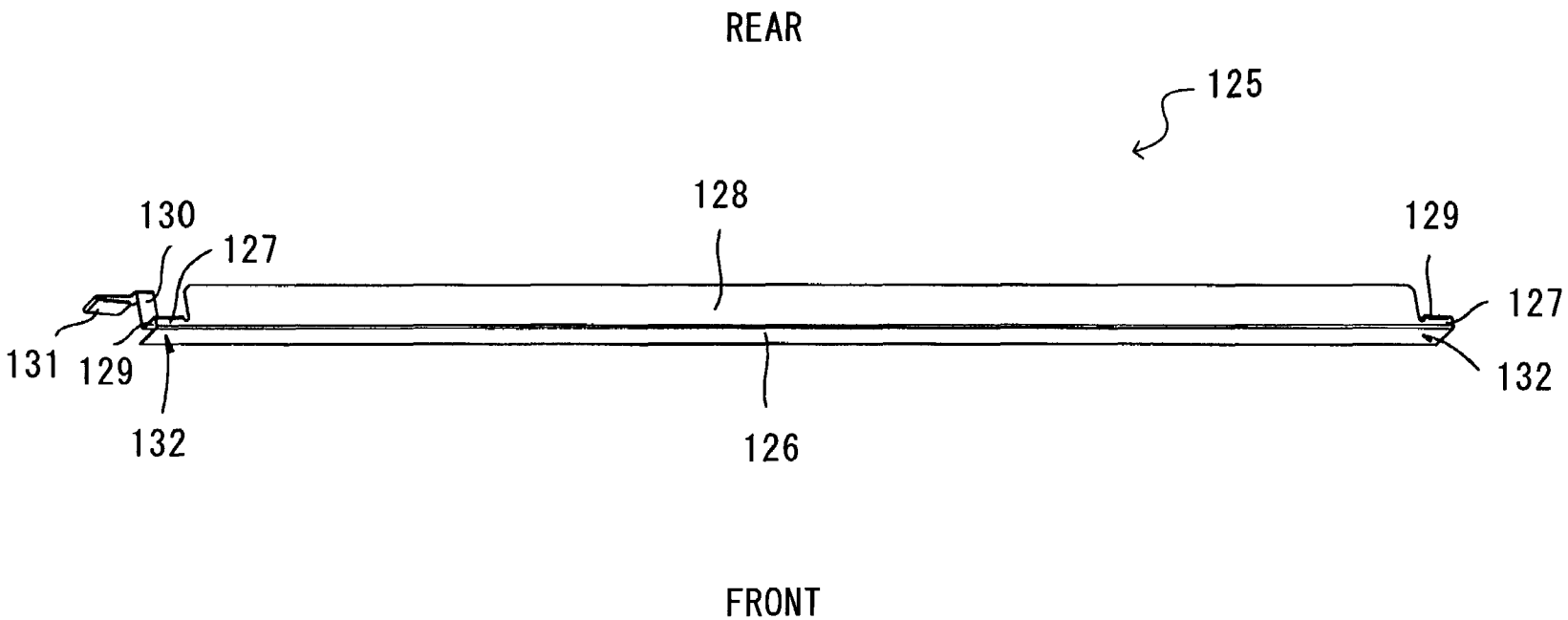
FIG. 6 is a perspective view of a brush holder shown in FIG. 3.

The brush 31 is disposed at the brush mounting portion 123 behind the photosensitive drum 28 so as to contact the surface of the photosensitive drum 28. More specifically, as shown in FIG. 3, the brush 31 is attached to the brush holder 125 of a substantially rectangular shape that extends in the longitudinal direction of the brush 31. The brush holder 125 is formed longer than the length of the brush 31. As shown in FIG. 6, the brush holder 125 includes a brush attachment portion 126, the extended end portion 127, an extended central portion 128, a downward extended portion 129, an electrode connection portion 130, and an electrode portion 131, which are integrally formed by bending a metal plate. The brush attachment portion 126 extends along the longitudinal direction of the brush 31. The extended end portion 127 extends rearward from the upper edge of the brush attachment portion 126 at each end thereof with respect to the longitudinal direction. The extended central portion 128 extends rearward from the upper edge of the brush attachment portion 126 at a central portion thereof with respect to the longitudinal direction. The downward extended portion 129 extends downward from the rear end of each extended end portion 127. The electrode connection portion 130 extends rearward from the lower end of one of the downward extended portions 129 (left side in FIG. 6). The electrode portion 131 extends downward from the rear end of the electrode connection portion 130 and extends leftward in FIG. 6 along the longitudinal direction of the brush holder 125. The electrode portion 131 is bent frontward.

With such structures, the brush holder 125 has, at each end thereof with respect to its longitudinal direction, a substantially U-shaped recess 132 in a side view, as a supported portion or an engagement portion, defined by the end portion of the brush attachment portion 126 with respect to its longitudinal direction, the extended end portion 127, and the downward extended portion 129.

Figure 5:
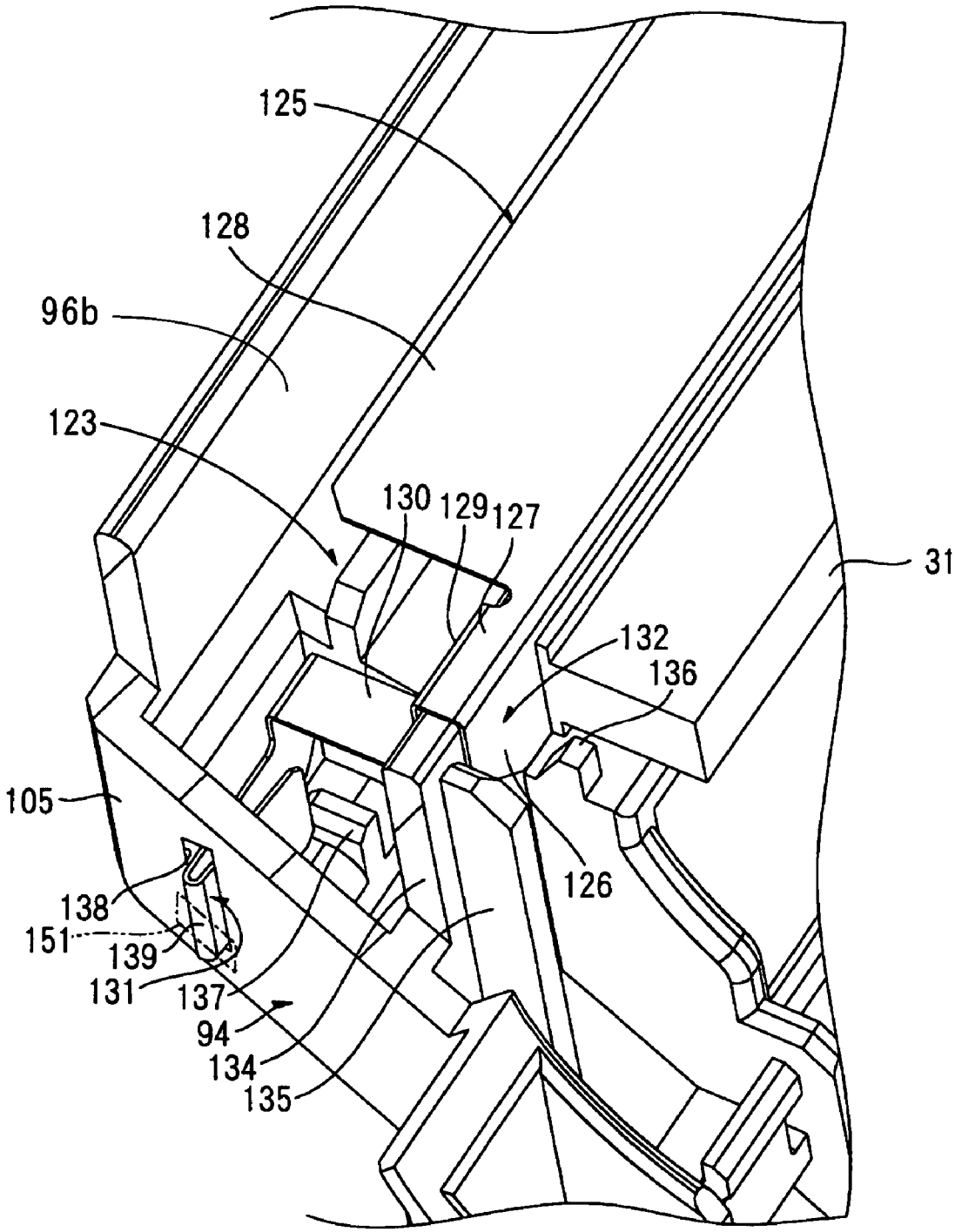
FIG. 5 is a perspective view of the parts of a lower frame shown in FIG. 3.

As shown in FIGS. 4 and 11, the brush mounting portion 123 is defined by the rear portion 96*b* of the bottom wall 96 and a lower wall 133 that extends between the rear wall portions 105 of the left and right side walls 94, 95. As shown in FIG. 5, the brush mounting portion 123 is provided with the holder supporting wall 134, as a supporter or a projection, a holder movement restricting member 135, a lifting prevention member 136, and an electrode movement restricting member 137. An electrode slit 138 is formed in the brush mounting portion 123 on the rear wall portion 105 of the left side wall 94. The electrode portion 131 of the brush holder 125 is fitted into the electrode slit 138, when the brush holder 125 is supported by the holder supporting wall 134.

The holder supporting wall 134 extends substantially vertically from the lower wall 133 in front of the electrode slit 138. The holder supporting wall 134 is disposed opposite the photosensitive drum 28 behind the drum 28, with a predetermined distance therebetween. The holder supporting wall 134 is formed of a rectangular plate extending along the longitudinal direction of the lower frame 92. The holder supporting wall 134 engages, at each end thereof with respect to its longitudinal direction, with the recess 132 of the brush holder 125, thereby supporting the brush holder 125.

The holder movement restricting member 135 extends from the lower wall 133 in front of an end (left end) of the holder supporting wall 134 with respect to its longitudinal direction. The holder movement restricting member 135 extends in the vertical direction up to the substantially same height as the holder supporting wall 134. The rear end of the holder movement restricting member 135 is connected to the holder supporting member 134, such that the holder movement restricting member 135 and the holder supporting member 134 form a substantially "T" shape in top view. With the brush holder 125 supported by the holder supporting wall 134, the holder movement restricting member 135 faces an end of the brush attachment portion 126 of the brush holder 125 with respect to the longitudinal direction of the brush attachment portion 126. Thus, the movement of the brush holder 125 in the longitudinal direction thereof can be prevented.

The lifting prevention member 136 is disposed, with the brush holder 125 supported by the holder supporting wall 134, in front of each end of the brush attachment portion 126 with respect to its longitudinal direction to face the lower edge of the brush attachment portion 126. The lifting prevention member 136 is formed, as a projection, into a substantially triangular shape in side view. It should be noted that only one lifting prevention member 136 is illustrated in FIG. 5. Movement of the lower end of the brush attachment portion 126 (upstream end in the rotating direction of the photosensitive drum 28) toward the photosensitive drum 28 in accordance with the rotation thereof can be prevented with the lifting prevention members 136.

The electrode movement restricting member 137 extends in the vertical direction, as well as the frontward and rearward direction. The electrode movement restricting member 137 is formed at a position to face, from inside, the free end of the electrode portion 131, when the brush holder 125 is supported by the holder supporting wall 134 and the electrode portion 131 is fitted into the electrode slit 138. When a contact point 139 that contacts, when the process cartridge 18 is installed in the main casing 2, a feeding member 151 (in FIG. 5) disposed in the main casing 2, contacts the feeding member 151, the movement of the electrode portion 131 in the longitudinal direction of the brush holder 125 can be prevented by the electrode movement restricting member 137.

As shown in FIG. 3, the brush 31 is attached to a front surface of the brush attachment portion 126 opposite to a rear surface facing the downward extended portion 129. The brush 31 is disposed behind the photosensitive drum 28 so as to contact the surface of the photosensitive drum 28 when the brush holder 125 is supported between the lower frame 92 and the upper frame 93.

More specifically, to support the brush holder 125 between the lower frame 92 and the upper frame 93, the electrode portion 131 is first inserted into the electrode slit 138 from inside the drum cartridge 25. A bent portion of the electrode portion 131 is projected outwardly from the electrode slit 138 along the longitudinal direction of the brush holder 125, as shown in FIG. 5. The brush holder 125 is pivoted about the electrode portion 131 inserted into the electrode slit 138, to move down the other end of the holder 125 where the electrode portion 131 is not provided, such that the recess 132 at each end of the holder 125 fits on the holder supporting wall 134. Then, the upper frame 93 is set relative to the lower frame 92, as shown in FIG. 11. The contact surface 147 of each supporting rib 124 of the upper frame 93 contacts the respective extended end portion 127 of the brush holder 125, so that the extended end portions 127 are pressed toward the holder supporting wall 134 by the contact surfaces 147 of the supporting ribs 124. Thus, each extended end portion 127 is held between the respective supporting rib 124 and the holder supporting wall 134. Accordingly, the brush holder 125 is supported between the lower frame 92 and the upper frame 93.

The bent portion of the electrode portion 131, which is protruded outwardly from the electrode slit 138 along the longitudinal direction of the brush holder 125, is the contact point 139 for contacting, when the process cartridge 18 is installed in the main casing 2, the feeding member 151 (in FIG. 5). A cleaning bias is applied to the contact point 139 from the feeding member 151, to electrically attract foreign materials to the brush 31.

The developing cartridge 26 is removably set in the drum cartridge 25. As shown in FIG. 1, the developing cartridge 26 has a box-shaped case 36 that is open rearward, and a supply roller 37, a developing roller 38, and a layer-thickness regulating blade 39 that are disposed in the case 36. The developing cartridge 26 can be installed in or removable from the main casing 2 together with the drum cartridge 25.

Disposed in the case 36 is a partition plate 40 that extends downward from an upper surface of the case 36 along the longitudinal direction of the case 36. A toner chamber 41 is defined in an internal space of the case 36 on the front side thereof partitioned by the partition plate 40. A developing chamber 42 is defined in an internal space of the case 36 on the rear side thereof partitioned by the partition plate 40.

The toner chamber 41 contains positively chargeable non-magnetic single-component toner as a developing agent. The toner is, for example, polymerized toner that is obtained by copolymerizing polymerizable monomers using a known polymerization method, such as a suspension polymerization method. The polymerizable monomers may be styrene-based monomers, such as styrene, and acrylic-based monomers, such as acrylic acid, alkyl (C1-C4) acrylate, and alkyl (C1-C4) methacrylate. The particle shape of such polymerized toner is substantially spherical, and thus the polymerized toner has excellent fluidity and contributes to high-quality image formation. The toner is mixed with wax and a coloring agent, such as carbon black, as well as an external additive, such as silica, to improve the fluidity of the toner. Toner particle sizes are approximately 6 to 10 μm.

An agitator 43 that agitates the toner in the toner chamber 41 is provided in the toner chamber 41. The agitator 43 is supported by an agitator rotating shaft 44 disposed at a central portion of the toner chamber 41. The agitator rotating shaft 44 extends along the longitudinal direction of the case 36. As the agitator 43 is rotated about the agitator rotating shaft 44, the toner in the toner chamber 41 is agitated, and is discharged toward the developing chamber 42, through an opening 45 formed below the partition plate 40.

The supply roller 37 is disposed at a lower front portion in the developing chamber 42. The supply roller 37 is rotatably supported between side walls of the case 36 that face each other in the longitudinal direction of the case 36. The supply roller 37 includes a metal supply roller shaft 46 that extends in the longitudinal direction of the case 36 and is covered by a sponge roller 47 formed of a conductive foaming material.

The developing roller 38 is disposed at a lower rear portion in the developing chamber 42. The developing roller 38 is rotatably supported between the side walls of the case 36 that face each other in the longitudinal direction of the case 36. A surface of the developing roller 38 is partly exposed from a rear portion of the case 36. When the developing cartridge 26 is set with the drum cartridge 25, the developing roller 38 faces the photosensitive drum 28 in the frontward and rearward direction. The developing roller 38 includes a metal developing roller shaft 48 covered by a rubber roller 49 formed of conductive rubber material. The rubber roller 49 is formed of a conductive urethane or silicone rubber including fine carbon particles. A surface of the rubber roller 49 is coated with urethane rubber or silicone rubber including fluorine. The rubber roller 49 contacts the sponge roller 47 of the supply roller 37 so as to apply some pressures to each other.

The layer-thickness regulating blade 39 is formed of a metal plate spring member. The layer-thickness regulating blade 39 includes a pressing rubber member 50 that has a semicircular cross-sectional shape and is formed of insulating silicone rubber. The layer-thickness regulating blade 39 is supported by the case 36 above the developing roller 38. The pressing rubber member 50 of the layer-thickness regulating blade 39 contacts, from the front side, the rubber roller 49 of the developing roller 38, and is pressed toward the rubber roller 49 by elastic force of the layer-thickness regulating blade 39.

Toner discharged to the developing chamber 42 through the opening 45 by the rotation of the agitator 43 is supplied onto the rubber roller 49 of the developing roller 38 by the rotation of the supply roller 37. At this time, toner is positively charged by the friction between the sponge roller 47 of the supply roller 37 and the rubber roller 49 of the developing roller 38. Toner supplied onto the rubber roller 49 of the developing roller 38 enters between the pressing rubber member 50 of the layer-thickness regulating blade 39 and the rubber roller 49. In accordance with the rotation of the developing roller 38, toner is carried on the rubber roller 49 as a thin layer whose thickness has been regulated.

While the photosensitive drum 28 rotates, the surface of the photosensitive drum 28 is uniformly and positively charged by the scorotron charger 29. Then, a laser beam from the scanner unit 17 scans across the surface of the photosensitive drum 28 at high speed, thereby forming, on the surface of the photosensitive drum 28, an electrostatic latent image based on image data.

Thereafter, as toner, which is carried on the rubber roller 49 of the developing roller 38 and positively charged, makes contact with the photosensitive drum 28 in accordance with the rotation of the developing roller 38, toner is supplied to the electrostatic latent image formed on the surface of the photosensitive drum 28, that is, parts exposed to a laser beam, where the potential level is lower than the remaining part of the photosensitive drum 28 surface uniformly positively charged. Thus, toner is selectively carried on the photosensitive drum 28, making the electrostatic latent image visible. Thus, a toner image is formed on the photosensitive drum 28.

Then, the photosensitive drum 28 and the transfer roller 30 are driven so as to convey the sheet 3 therebetween. The toner image carried on the photosensitive drum 28 is transferred onto the sheet 3 while the sheet 3 is fed between the photosensitive drum 28 and the transfer roller 30.

Paper fibers or powders attached, after the toner image transfer, to a surface of the photosensitive drum 28 due to the contact to the sheet 3 are physically caught by the brush 31 when the brush 31 is brought into contact with the surface of the photosensitive drum 28 in accordance with the rotation of the photosensitive drum 28, and attracted to the brush 31 by the application of the cleaning bias to the electrode portion 131 from the feeding member 151.

The fixing unit 19 is provided behind the process cartridge 18. The fixing unit 19 includes a unit frame 51, a heat roller 52 and a pressure roller 53 that are rotatably disposed in the unit frame 51 such that the heat roller 52 is disposed above the pressure roller 53 in contact therewith.

The heat roller 52 includes a metal tube accommodating a halogen lamp as a heat source. The heat roller 52 is rotated by an input of power from a motor (not shown).

The pressure roller 53 is disposed below the heat roller 52 in contact with the heat roller 52 so as to press against the heat roller 52. The pressure roller 53 includes a metal roller shaft 80 covered by a roller 81 formed of a rubber material. The pressure roller 53 is driven by the rotation of the heat roller 52.

In the fixing unit 19, toner transferred onto the sheet 3 is thermally fixed while the sheet 3 passes between the heat roller 52 and the pressure roller 53. The sheet 3 having toner fixed thereon, is conveyed to a sheet discharge path 82 that extends in the vertical direction toward the top surface of the main casing 2. The sheet 3 conveyed to the sheet discharge path 82 is discharged by discharge rollers 83 disposed at an upper end of the sheet discharge path 82, onto a sheet discharge tray 84, which is formed on an upper face of the main casing 2.

In the process cartridge 18 of the laser printer 1, the brush holder 125 that supports the brush 31 is formed of metal plate. The brush holder 125 is integrally formed with the brush attachment portion 126, the extended end portion 127, the extended central portion 128, the downward extended portion 129, the electrode connection portion 130, and the electrode portion 131. Therefore, the number of components to be used for the process cartridge 18 can be reduced as compared with a case where the electrode portion 131 is separately provided.

The brush holder 125 is supported by the holder supporting wall 134 by fitting the recesses 132 of the brush holder 125 on the holder supporting wall 134. Thus, the brush 31, attached to the brush attachment portion 126, and the electrode portion 131 are positioned properly. Accordingly, the assembly of the process cartridge 18 can be improved.

After the recesses 132 of the brush holder 125 are fitted on the holder supporting wall 134, the upper frame 93 is set relative to the lower frame 92, to press the extended end portions 127 of the brush holder 125 toward the holder supporting wall 134 with the respective supporting ribs 124 of the upper frame 93. Thus, the brush holder 125 can be supported with the supporting ribs 124 and the holder supporting wall 134. With a simple structure, support of the brush holder 125 can be achieved. Further, the assembly of the process cartridge 18 can be improved.

By making the contact surfaces 147 of the supporting ribs 124 contact with the extended end portions 127 of the brush holder 125, the brush holder 125 is pressed toward the holder supporting wall 134 at two positions at each end of the brush holder 125 with respect to its longitudinal direction. Therefore, the brush holder 125 can be supported stably between the supporting ribs 124 and the holder supporting wall 134. Consequently, the brush holder 125 can be securely supported with the holder supporting wall 134 and the extended end portions 127.

The supporting ribs 124 extend perpendicular to the longitudinal direction of the brush holder 125. With such a structure, the brush holder 125 can be stably supported with the supporting ribs 124.

The brush holder 125 is formed by bending a metal plate. Thus, the brush holder 125 has relatively strong strength, and the flatness of the brush attachment portion 126 can be improved. Further, the brush holder 125 is formed longer than the brush 31 and the recess 132 is formed in the brush holder 125 at each end thereof with respect to its longitudinal direction where the brush 31 is not attached. Thus, the brush attachment portion 126 can be processed to have a high strength and a good surface accuracy. The extended end portions 127 are not in the way when the brush 31 is attached to the brush attachment portion 126, so that the brush 31 can be readily attached to the brush attachment portion 126. Consequently, while improving ease of attachment of the brush 31, the strength and the surface accuracy of the brush attachment portion 126 can be improved, and in turn, assembly of the process cartridge 18 can be improved.

Further, the brush holder 125 is formed longer than the brush 31 and the electrode portion 131 is formed in the brush holder 125 at an end thereof with respect to its longitudinal direction where the brush 31 is not attached. Thus, the electrode portion 131 can be processed to have a high strength and a good surface accuracy. The electrode portion 131 is not in the way when the brush 31 is attached to the brush attachment portion 126, so that the brush 31 can be readily attached to the brush attachment portion 126. Consequently, while improving ease of attachment of the brush 31, the strength and the surface accuracy of the brush attachment portion 126 can be improved, and in turn, assembly of the process cartridge 18 can be improved.

The contact point 139 that contacts the feeding member 151 is provided at the bent portion of the electrode portion 131, so that reliable contact of the contact point 139 to the feeding member 151 can be achieved. When the brush holder 125 is supported by the holder supporting wall 134 and the electrode portion 131 is inserted into the electrode slit 138, the electrode movement restricting member 137 faces the free end of the electrode portion 131. When the contact point 139 of the electrode portion 131 contacts the feeding member 151, the movement of the electrode portion 131 in the longitudinal direction of the brush holder 125 can be prevented by the electrode movement restricting member 137. Thus, reliable contact of the contact point 139 of the electrode portion 131 to the feeding member 151 can be achieved.

The contact point 139 of the electrode portion 131 protrudes outwardly from the electrode slit 138 along the longitudinal direction of the brush holder 125. The contact point 139 of the electrode portion 131 can make contact with the feeding member 151 outside the lower frame 92. Thus, the contact between the electrode portion 131 and the feeding member 151 can be readily made.

The lifting prevention members 136 are disposed, when the brush holder 125 is supported by the holder supporting wall 134, to face the lower ends of the front surface of the brush attachment portion 126 with respect to its longitudinal direction. Therefore, movement of the lower end of the brush attachment portion 126 toward the photosensitive drum 28 in accordance with the rotation thereof can be prevented with the lifting prevention members 136. Thus, reliable contact of the brush 31 to the photosensitive drum 28 can be ensured. Consequently, foreign materials attached to the photosensitive drum 28 can be removed cleanly.

The holder movement restricting member 135 is disposed, when the brush holder 125 is supported by the holder supporting wall 134, to face one end of the brush attachment portion 126 with respect to its longitudinal direction. Thus, the movement of the brush holder 125 in the longitudinal direction thereof can be prevented. Therefore, disconnection between the electrode portion 131 and the feeding member 151, or changes in the contact position of the brush 31 to the photosensitive drum 28, due to the movement of the brush holder 125, can be prevented.

The holder movement restricting member 135 is disposed on the same side that the electrode portion 131 is provided, with respect to the longitudinal direction of the brush holder 125. When the brush holder 125 is positioned with respect to its longitudinal direction by making the holder movement restricting member 135 contact the end of the brush holder 125 on the side of the electrode portion 131, variances in the amounts of projection of the electrode portion 131 from the electrode slit 138, due to the dimensional tolerance of the length of the brush holder 125, can be regulated. Thus, the projection amount of the electrode portion 131 from the electrode slit 138 can be maintained to a specified amount, and reliable contact between the electrode portion 131 and the feeding member 151 can be made. Further, the holder movement restricting member 135 is disposed on the same side that the electrode portion 131 is provided with respect to the longitudinal direction of the brush holder 125, so that the movement of the electrode portion 131 in the longitudinal direction of the brush holder 125 can be prevented. Accordingly, disconnection between the electrode portion 131 and the feeding member 151 due to the movement of the brush holder 125 can be prevented.

The laser printer 1 is provided with the process cartridge 18 that can reduce the number of components used in the process cartridge 18 and can improve the assembly of the process cartridge 18. Consequently, the number of components used in the laser printer 1 can be reduced, and assembly can be made easier.

Figure 7:
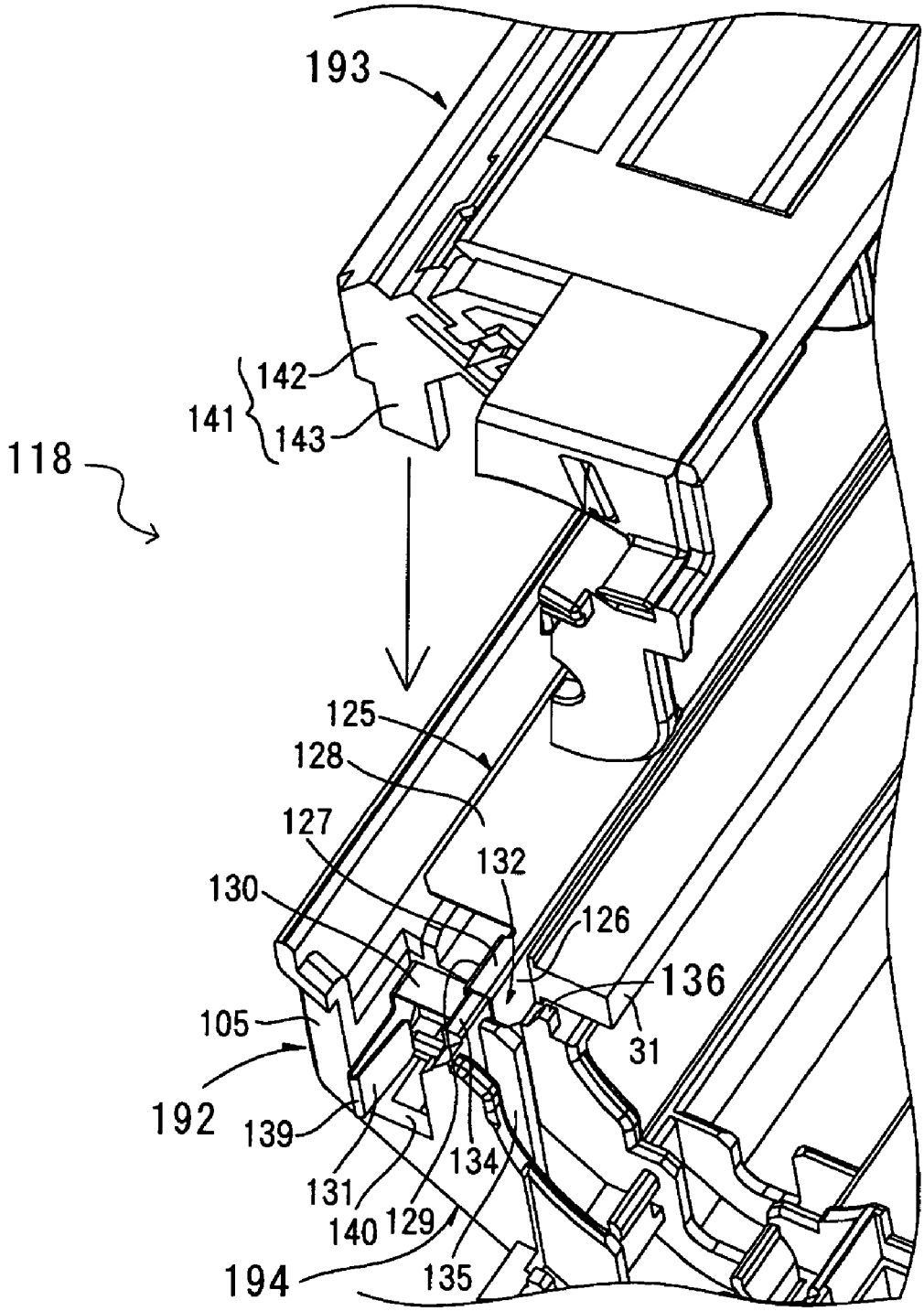
FIG. 7 is an enlarged perspective view of the parts of a lower frame and an upper frame of the process cartridge according to another illustrative embodiment.

A process cartridge 118 according to a modification of the illustrative embodiment will be described below, with reference to FIGS. 7 and 8. It should be noted that similar reference numerals denote similar elements.

In the process cartridge 118, the electrode slit 138 is not formed in a lower frame 192. The electrode slit 138 into which the electrode portion 131 is inserted, is defined when the lower frame 192 and an upper frame 193 are put together. More specifically, in the lower frame 192, an electrode receiving portion 140 is formed in the rear wall portion 105 of the left side wall 194 by cutting out a part of the rear wall portion 105 into a substantially rectangular shape from the upper edge of the rear wall portion 105. When the brush holder 125 is supported by the holder supporting wall 134, the electrode portion 131 of the brush holder 125 is received by the electrode receiving portion 140.

Formed in the upper frame 193 is an engagement portion 141 that engages with the electrode receiving portion 140 of the lower frame 192 when the upper frame 193 is put together with the lower frame 192. The width of the engagement portion 141 with respect to the frontward and rearward direction is substantially the same as that of the electrode receiving portion 140. The engagement portion 141 includes an upper engagement portion 142 and a lower engagement portion 143. The upper engagement portion 142 fits in the electrode receiving portion 140 substantially without a gap. The lower engagement portion 143 is formed by cutting out a lower rear portion of the upper engagement portion 142 into a substantially rectangular shape.

Figure 8:
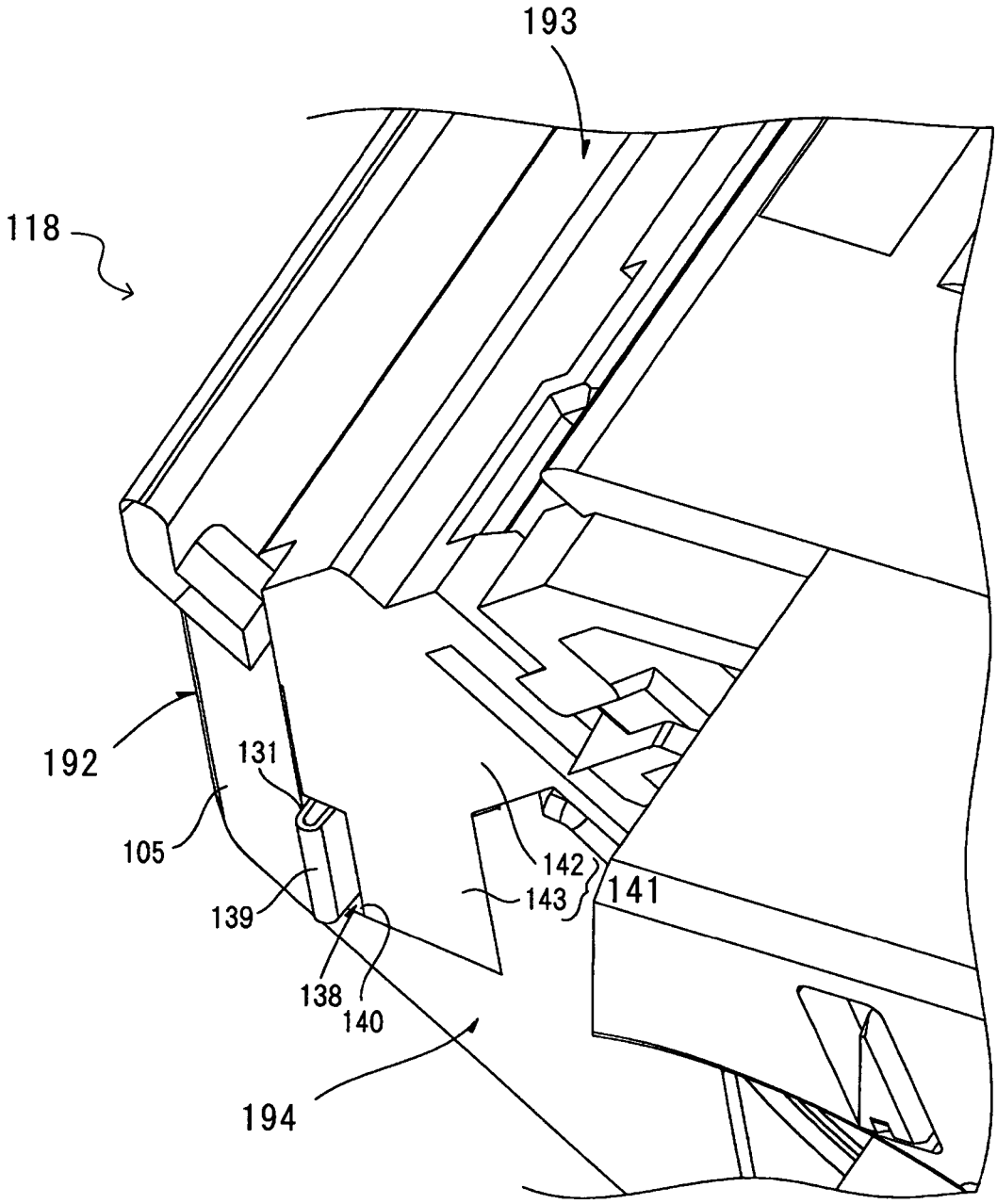
FIG. 8 is an enlarged perspective view of the parts of the lower frame and the upper frame shown in FIG. 7 that are put together.

As the lower frame 192 and the upper frame 193 are put together, the engagement portion 141 of the upper frame 193 is engaged in the electrode receiving portion 140 of the lower frame 192, as shown in FIG. 8. Thus, the electrode slit 138 of a substantially rectangular shape is formed between the lower engagement portion 143 and the lower frame 192. After the electrode portion 131 is fitted in the electrode receiving portion 140, the engagement portion 141 is engaged in the electrode receiving portion 140. Thus, the electrode slit 138 can be formed after the setting of the electrode portion 131 in electrode receiving portion 140, and the contact point 139 of the electrode portion 131 can be protruded outwardly from the electrode slit 138 along the longitudinal direction of the brush holder 125. With such a simple arrangement, the insertion of the electrode portion 131 into the electrode slit 138 can be readily performed.

A lower frame 292 according to a modification of the illustrative embodiment will be described below, with reference to FIG. 9.

Figure 9:
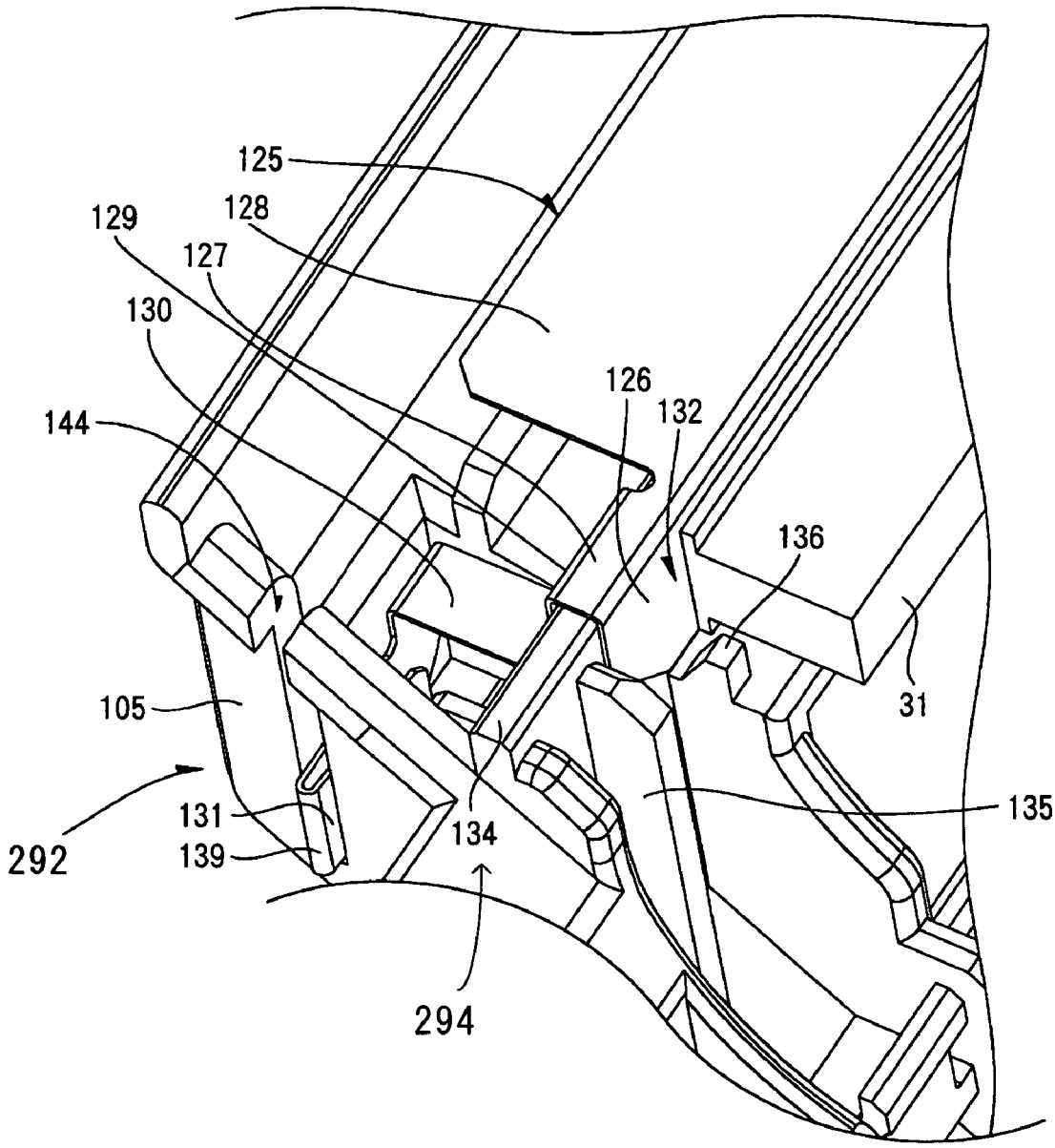
FIG. 9 is an enlarged perspective view of the parts of a lower frame according to yet another illustrative embodiment.

As shown in FIG. 9, in the lower frame 292, the rear wall portion 105 of the left side wall 294 has an electrode groove 144 that is formed into a substantially rectangular shape by cutting out a part of the rear wall portion 105 of the left side wall 294 from the upper edge thereof. The electrode portion 131 can be inserted from above into the electrode groove 144. As the electrode portion 131 is inserted into the electrode groove 144, the electrode portion 131 protrudes outside the lower frame 292 from the electrode groove 144.

With such a structure, the contact point 139 of the electrode portion 131 can readily be made to contact the feeding member outside the lower frame 292.

Figure 10:
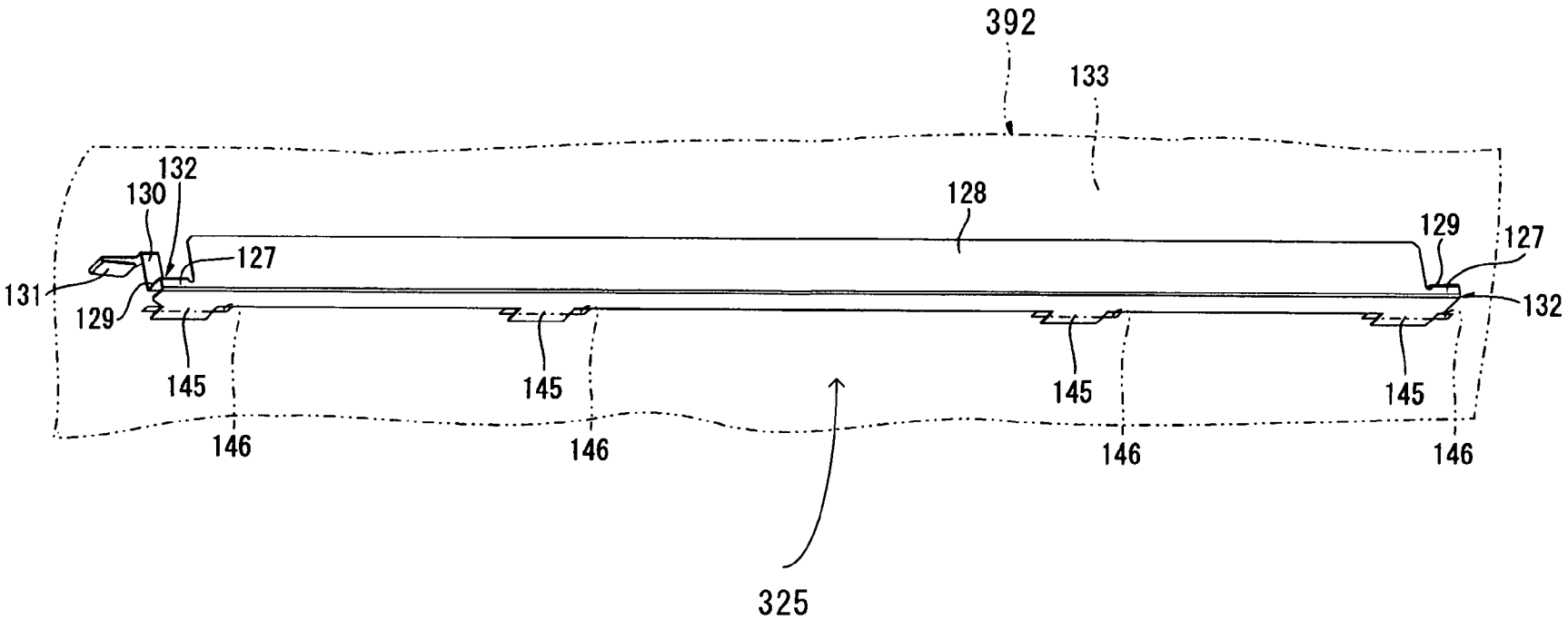
FIG. 10 is a perspective view of a brush holder according to still another illustrative embodiment.

A brush holder 325 according to a modification of the illustrative embodiment will be described with reference to FIG. 10. The brush holder 325 has a plurality of insertion parts 145 formed into a substantially rectangular shape so as to extend downwardly from the lower end of the brush attachment portion 126. The insertion parts 145 are disposed with a predetermined distance between the adjacent insertion parts 145. Insertion grooves 146, into which the insertion parts 145 are inserted when the brush holder 125 is supported by the holder supporting wall 134, are formed, in association with the insertion parts 145, on the lower wall 133 (as seen in FIG. 4) of a lower frame 92.

With such a structure, each of the insertion parts 145 is inserted into the respective insertion grooves 146, so that the lower end of the brush attachment portion 126 does not move toward the photosensitive drum 28 in accordance with the rotation of the photosensitive drum 28. Therefore, reliable contact of the brush 31 to the photosensitive drum 28 can be made. Consequently, foreign material attached to the photosensitive drum 28 can be removed cleanly.

In the above described illustrative embodiment, the holder supporting wall 134 is formed as a protruding wall and the recesses 132 are fitted on the protruding holder supporting wall 134 to support the brush holder 125. However, a boss may be used to support the brush holder 125. In this case, the brush holder 125 may have an opening such that the brush holder 125 can be supported by the boss by inserting the opening of the brush holder 125 over the boss.

While this disclosure has been described in conjunction with the exemplary embodiments outlined above, various alternatives, modifications, variations, improvements and/or substantial equivalents, whether known or that may be presently unforeseen, may become apparent to those having at least ordinary skill in the art. Accordingly, the exemplary embodiments of the disclosure, as set forth above, are intended to be illustrative, not limiting. Various changes may be made without departing from the spirit and scope of the disclosure. Therefore, the disclosure is intended to embrace all known or later developed alternatives, modifications, variations, improvements and/or substantial equivalents.

What is claimed is:

1. A process cartridge, comprising:

an image carrying member carrying a developer image thereon;

a brush for removing foreign material attached to the image carrying member;

a brush holder integrally formed with a supported portion, a brush attachment portion to which the brush is attached, and an electrode portion to which voltage is applied to electrically attract the foreign material to the brush, the brush holder being formed of a metal plate, the supported portion being formed on a first side of the brush holder;

a cartridge frame accommodating the image carrying member, the brush and the brush holder, the cartridge frame including a first frame including a supporter supporting the supported portion, the supporter including a first contact portion that contacts the supported portion, and a second frame that is separately formed from the first frame and configured to mate with the first frame, the second frame including a second contact portion that contacts the brush holder from a side opposite to the first side, the second frame urging the supported portion of the brush holder toward the supporter.

2. The process cartridge according to claim 1, wherein the supporter includes a protrusion provided on the cartridge frame and the supported portion is provided with an engagement portion that engages with the protrusion.

3. The process cartridge according to claim 1, wherein the second contact portion is a rib that extends in a direction perpendicular to a longitudinal direction of the brush.

4. The process cartridge according to claim 1, wherein the brush attachment portion is formed at a face that is formed by bending the metal plate.

5. The process cartridge according to claim 1, wherein the brush holder is formed longer than a length of the brush, and the supported portion is formed on a side of the brush holder where the brush is unattached with respect to a longitudinal direction of the brush.

6. The process cartridge according to claim 1, wherein the brush holder is formed longer than a length of the brush, and the electrode portion is formed on a side of the brush holder where the brush is unattached, with respect to a longitudinal direction of the brush.

7. The process cartridge according to claim 1, wherein the electrode portion is formed by bending the metal plate, and a contact point that contacts a feeding member for applying voltage to the electrode portion, is formed at a bent portion of the metal plate.

8. The process cartridge according to claim 7, wherein the electrode portion is formed by bending an end of the metal plate, with respect to a longitudinal direction of the metal plate, and an electrode movement restricting member that restricts movement of the electrode portion by contacting a free end of the electrode portion when the contact point contacts the feeding member, is provided in the cartridge frame.

9. The process cartridge according to claim 7, wherein the cartridge frame is formed with an electrode slit into which the electrode portion is inserted and when the electrode portion is inserted into the electrode slit, the contact point protrudes outside the cartridge frame.

10. The process cartridge according to claim 9, wherein the cartridge frame includes a first frame and a second frame that is formed separately from the first frame and configured to mate with the first frame, the first frame having an electrode receiving portion capable of receiving the electrode portion, and the second frame having an engagement portion that engages with the electrode receiving portion to form the electrode slit between the electrode receiving portion and the engagement portion.

11. The process cartridge according to claim 7, wherein the cartridge frame has an electrode groove into which the electrode portion is insertable from a direction perpendicular to the longitudinal direction of the brush holder, and when the electrode portion is inserted into the electrode groove, the contact point protrudes outside the cartridge frame.

12. The process cartridge according to claim 1, wherein the brush attachment portion is disposed in contact with a surface of the image carrying member, and a lifting prevention member disposed in the cartridge frame is configured to prevent an upstream end of the brush attachment portion with respect to a rotating direction of the image carrying member from moving toward the image carrying member during rotation of the image carrying member.

13. The process cartridge according to claim 1, wherein the brush attachment portion is disposed opposite a surface of the image carrying member, an insertion part provided that extends toward an upstream side with respect to a rotating direction of the image carrying member is provided at an upstream end, with respect to the rotating direction of the image carrying member, of the brush attachment portion, and the cartridge frame has an insertion groove into which the insertion part is inserted.

14. The process cartridge according to claim 1, wherein a holder movement restricting member provided in the cartridge frame is configured to restrict movement of the brush holder in a longitudinal direction thereof.

15. The process cartridge according to claim 14, wherein the electrode portion is provided at an end of the brush holder, with respect to the longitudinal direction thereof, on a side where the holder movement restricting member is provided.

16. An image forming apparatus, comprising:

a process cartridge including:

an image carrying member carrying a developer image thereon;

a brush for removing foreign material attached to the image carrying member;

a brush holder integrally formed with a supported portion, a brush attachment portion to which the brush is attached, and an electrode portion to which voltage is applied to electrically attract the foreign material to the brush, the brush holder being formed of a metal plate, the supported portion being formed on a first side of the brush holder;

a cartridge frame accommodating the image carrying member, the brush and the brush holder, the cartridge frame including a first frame including a supporter supporting the supported portion, the supporter including a first contact portion that contacts the supported portion, and a second frame that is separately formed from the first frame and configured to mate with the first frame, the second frame including a second contact portion that contacts the brush holder from a side opposite to the first side, the second frame urging the supported portion of the brush holder toward the supporter.

17. A process cartridge, comprising:

an image carrying member carrying a developer image thereon;

a brush for removing foreign material attached to the image carrying member;

a brush holder integrally formed with a recessed supported portion and a brush attachment portion to which the brush is attached, the recessed supported portion being formed on a first side of the brush holder;

a cartridge frame accommodating the image carrying member, the brush and the brush holder, the cartridge frame including a first frame including a supporter formed into a projection which engages with the supported portion, the supporter including a first contact portion that contacts the supported portion; and a second frame that is separately formed from the first frame and configured to mate with the first frame, the second frame including a second contact portion that contacts the brush holder from a side opposite to the first side, the second frame urging the supported portion of the brush holder toward the supporter, wherein the brush holder is formed of a metal plate and integrally formed with the supported portion, the brush attachment portion, and an electrode portion for electrically attracting the foreign material to the brush.

* * * * *